US006761769B2

(12) United States Patent
Inaba et al.

(10) Patent No.: US 6,761,769 B2
(45) Date of Patent: Jul. 13, 2004

(54) APPARATUS FOR APPLYING VISCOUS MATERIAL

(75) Inventors: Yuzuru Inaba, Yamanashi-ken (JP); Eiichiro Terayama, Kofu (JP); Naoichi Chikahisa, Kofu (JP); Shunji Hashimoto, Kofu (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 239 days.

(21) Appl. No.: 10/075,620

(22) Filed: Feb. 15, 2002

(65) Prior Publication Data

US 2002/0112821 A1 Aug. 22, 2002

(30) Foreign Application Priority Data

Feb. 16, 2001 (JP) ..... 2001-040368

(51) Int. Cl.[7] ..... B05C 11/00

(52) U.S. Cl. ..... 118/696; 118/50; 118/305; 118/323; 118/500; 118/600

(58) Field of Search ..... 118/696, 50, 305, 118/323, 500, 600

*Primary Examiner*—Bernard Pianalto
(74) *Attorney, Agent, or Firm*—Wenderoth, Lind & Ponack, L.L.P.

(57) ABSTRACT

An applicator has a rubber heater (51) attached to the outer peripheral surface of the application member (4) in the vicinity of a nozzle (3). Thereby, the temperature in the vicinity of the nozzle (3) is controlled by a control unit by detecting the temperature using a thermal resistor (52). A change in the viscosity of the viscous material (2) is prevented by keeping the temperature substantially constant, so that the volume of the viscous material from the nozzle (3) is stabilized.

12 Claims, 9 Drawing Sheets

APPARATUS FOR APPLYING VISCOUS MATERIAL

BACKGROUND OF THE INVENTION

The present invention relates to apparatus and method for applying a viscous material. In particular, the present invention relates to apparatus and method for applying adhesive on an electric circuit substrate, such as circuit board bearing electronic components thereon.

FIG. 4 illustrates a conventional adhesive applicator (100) for applying adhesive onto the circuit substrate for holding components thereon. The applicator (100) has an application head (110) for applying adhesive on the circuit substrate, a robot (130) for moving the head (110), a substrate holder (140) for introducing the circuit substrate into an interior of the applicator and then holding the substrate, and a controller (150) for controlling overall operations of the applicator. The robot (130) moves the head (110) in the X-direction by means of a motor (132), and the holder (140) moves the circuit substrate in the Y-direction by means of another motor (142). As a result of relative movement between the head (110) in X-direction and the holder (140) in Y-direction perpendicular to the X-direction in a horizontal plane, the head (110) may apple adhesive on a predetermined area of the circuit substrate. The moving distance of the head (110) in X-direction and that of the holder (140) in Y-direction are controlled by the controller (150).

Referring to FIG. 5, there is shown the head (110). The head (110) is equipped with three sets of applying mechanisms or units (111) each of which squeezes out the adhesive with an aid of air pressure applied thereto. Each of the applying units (111) has a syringe (113) with a nozzle (112) for receiving the adhesive and then discharging a predetermined volume of the adhesive through the nozzle (112) with an aid of air pressure, an air-supply (115) for supplying compressed air to the syringe (113), and an elevator (120) for moving the syringe (113) up and down in the Z-direction shown in the drawing so as to apply the adhesive on a circuit substrate.

FIG. 6 shows several elements of the applying unit (111) in FIG. 5. As can be seen from the drawing, the air-supply (115) has a passage (116) for supplying the compressed air to the syringe (113), and a valve (117) for regulating an amount of compressed air to be supplied. The elevator (120) has a hollow shaft (121) connected to the syringe (113) and allowing the compressed air to pass therethrough, a lever (123) rotatably mounted on a support shaft (122), a cam follower (124) rotatably fixed to the lever (123), and a cam (125) making an engagement with the cam follower (124). One end (123*a*) of the lever (123) is connected to the elevation shaft (121), and the other end (123*b*) thereof may contact with the drive shaft of a nozzle-selection cylinder (126). The lever (123) driven by the nozzle-selection cylinder (126) causes the cam follower (124) to engage with the cam (125). This causes that the one end (123*a*) of the lever (123) rotates around the support shaft (122) in association with the rotation of the cam (125), moving the elevation shaft (121) up and down in Z-direction.

Referring to FIGS. 4–6, an operation of the applicator (100) so structured will be described in detail. The head (110) conducts a trial application of the adhesive (102) on a trial tape (101) before the application of adhesive onto a circuit substrate. As shown in FIG. 6, when the valve (117) of the air-supply (115) is opened for a predetermined period of time, the float (114) inside the syringe (113) is forced down due to the air pressure. This causes a predetermined volume of the adhesive (102) to be discharged from the syringe (113) through the tip end (112*a*) of its nozzle (112). The cam follower (124) of the lever (123) comes into contact with the cam (125) by the actuation of the nozzle-selection cylinder (126). As mentioned above, the rotation of the cam (125) causes the one end (123*a*) of the lever (123) to rotate, thereby the syringe (113) is moved down in the Z-direction via the elevation shaft (121). Then, the adhesive (102) discharged from the tip end (112*a*) of the nozzle (112) is applied on the trial tape (101) opposing to the nozzle tip end (112*a*). (see FIG. 5) After the application of the adhesive, the syringe (113) is moved up to the original position due to further rotation of the cam (125).

The condition of the applied adhesive (102) on the trial tape is imaged by a recognition camera (118) mounted on the head (110) (see FIG. 5). The controller (150) measures the area of She adhesive applied on the trial tape based on the output from the recognition camera (118), and determines whether the measured area meets a predetermined and intended diameter of the adhesive to be applied. The trial application of the adhesive followed by the image-pickup operation is repeated until the measured diameter of the applied adhesive on the trial tape falls within the allowable range of the intended diameter. After the diameter of the adhesive applied on the trial tape has come within the allowable intended diameter range, a circuit substrate is introduced into the apparatus and then firmly held by the holder (140). Then, the operation of applying the adhesive (102) onto the circuit substrate is started.

The prior-art applicator (100) has several drawbacks. For example, the volume of the discharged adhesive (102) varies depending on remaining amount of the adhesive (102) in the syringe (113), since the adhesive (102) in the syringe (113) is forced out by means of air pressure. U.S. Pat. No. 5,564,606 and JP (A)-276963/1999 disclose certain techniques for solving the problem of volume fluctuations of discharged viscous materials or adhesive.

Referring to FIGS. 7 and 8, the application mechanism (1) disclosed in JP (A)-276963/1999 mainly has an adhesive-applying member (4) equipped with a nozzle (3) for discharging adhesive (2), a discharge shaft (5) rotatably inserted in the hollow interior of the adhesive-applying member (4) and extending in the longitudinal direction along the axis of the nozzle (3), a driving device (6) for is rotating the discharge shaft (5) around its axis, and an adhesive supply unit (8) for supplying the adhesive (2) to the adhesive-applying member (4). A portion of the mechanism (1) surrounded by a circle indicated by alphabet I is illustrated in 9 in detail. As shown in the drawing, a screw-like portion (11) is formed at one end of the discharge shaft (5) close to the nozzle (3) (lower side of the drawing). Connected to the other end (5*a*) of the discharge shaft (5) (upper side of the drawing) is a transmission shaft (13) mounted for sliding along the axial direction relative to a connecting shaft (12) and for transmitting a rotation of the connecting shaft (12) to the discharge shaft (5). As shown in FIG. 7, an output shaft (7) of the driving device (6) is connected to the other end of the connecting shaft (12) via a coupling (14). Thus, when the driving device (6) is operated, the discharge shaft (5) is caused to rotate around its axis via the output shaft (7), the coupling (14), the connecting shaft (12) and the slidable transmission shaft (13).

With reference to FIG. 9, a passage (16) for supplying the adhesive is formed in the adhesive-applying member (4) at a position corresponding to the upper end (11*a*) of the screw-like portion (11). The passage (16) is communicated with a flexible adhesive-supplying tube (18) via a fixture (17). The flexible adhesive-supplying tube (18) is connected to the syringe (9) of the adhesive supply unit (8) (see FIG. 7) through which the adhesive (2) accumulated in the syringe (9) is supplied. When the discharge shaft (5) is rotated around its axis, the adhesive (2) supplied to the upper end (11*a*) of the screw-like portion (11) is forced toward the other end (11*b*) of the screw-like portion (11) along the thread groove formed on the screw-like portion (11). Since the adhesive-applying member (4) has the nozzle (3) arranged coaxially with the discharge shaft (5), the adhesive (2) moved to the other end (11*b*) of the screw-like portion (11) is then squeezed into the nozzle (3) and discharged from one end (3*a*) of the nozzle (3).

A nozzle stopper (19) is provided to the adhesive-applying member (4), adjacent to and parallel to the nozzle (3). The nozzle stopper (19) extends slightly longer than the nozzle (3) so as to define a small gap between the circuit substrate (20) and the tip end (3*a*) of the nozzle (3) when the tip end (19*a*) of the nozzle stopper (19) contacts with the circuit substrate (20) (see FIG. 7). This gap is advantageously used when a predetermined volume of the adhesive discharged from the one end (3*a*) of the nozzle (3) is applied as a mass of the adhesive having a predetermined diameter on a predetermined position of the circuit substrate (20). The nozzle (3), the adhesive-applying member (4) and the discharge shaft (5) are arranged so that they move altogether in the axial direction. In order to absorb a shock caused at the contact of the nozzle stopper (19) with the circuit substrate (20), a cushion spring (21) is provided to the adhesive-applying member (4).

The connecting shaft (12) is inserted into the interior of a hollow spline shaft (23) mounted for sliding along the axial direction and for rotation about the axis. Referring again to FIG. 7, a moving member (24) is provided around the outer peripheral surface of the end portion of the spline shaft (23) near the driving device (6) (upper side of the drawing). A component of a nozzle-moving device (30) is engaged with the moving member (24) for driving the spline shaft (23) upward and downward in the drawing. The stroke of this upward and downward motion is indicated by a distance between the imaginary line (35) (the upward position) and the solid line (36) (the downward position). In association with this upward and downward motion, the adhesive-applying member (4) moves up and down, so that the adhesive is applied on the circuit substrate (20) when the nozzle (3) formed on the adhesive-applying member (4) is moved downward.

A spline housing (25) is arranged around the outer peripheral surface at one end of the spline shaft (23) near the adhesive-applying member (4) (the lower side of the drawing). The spline housing (25) supports the spline shaft (23) slidably along the axial direction, and drives the spline shaft (23) to rotate together with the spline housing (25). For this driving, the spline housing (25) is supported by the frame body (29) of the applicator via a bearing (26). A pulley (27) is fixed to the spline housing (25), and this pulley (27) is driven by another pulley (37) of the rotation device (31) for the adhesive-applying member shown in FIG. 8 around the axis of the spline shaft (23) via a timing belt. The rotation of the pulley (27) rotates the spline housing (25) around its axis, and the rotation of the spline housing (25) rotates the spline shaft (23) around its axis in the same direction. Then, the rotation of the spline shaft (23) rotates the adhesive-applying member (4) connected to the spline shaft (23), and hence the nozzle (3) is rotated.

Referring back to FIG. 7, the supply unit (8) has the syringe (9) holding the adhesive (2) therein, the adhesive-supplying tube (18) for introducing the adhesive (2) held in the syringe (9) into the adhesive-applying member (4), and the compressed air-supplying device (32) for supplying compressed air into the syringe (9) so as to force the adhesive (2) accumulated in the syringe (9) into the adhesive-supplying tube (18). The compressed air is used for overcoming the viscosity of the adhesive (2) to feed the adhesive into the adhesive-applying member (4). Then, the adhesive (2) is discharged from the nozzle (3) due to the rotation of the screw-like portion (11) of the discharge shaft (5).

The adhesive-applying member (4) has a rotation-restricting structure (40) to which the adhesive-supplying tube (18) is connected. The adhesive-applying member (4) is mounted for rotation so as to rotate the nozzle (3) around the nozzle axis. If the adhesive-supplying tube (18) is directly connected to the adhesive-applying member (4), the adhesive-supplying tube (18) synchronously follows the rotation of the adhesive-applying member (4). The rotation-restricting structure (40) is provided to restrict rotation of the adhesive-supplying tube (18) even when the adhesive-applying member (4) rotates.

Referring again to FIG. 9, the rotation-restricting structure (40) has a main body (41) to which the adhesive-supplying tube (18) is connected so as to receive the adhesive (2), a locking cap (42) for fastening and locking the main body (41), a guide roller (43) mounted on the main body (41), and a spring (44) for biasing and positioning the rotation-restricting structure (40) in place. The guide roller (43) is fitted inside the guide groove (45) formed in the frame body (29) for blocking rotation of the rotation-restricting structure (40) even while the adhesive-applying member (4) rotates, preventing the rotation of the adhesive-supplying tube (18) connected to the main body (41). When the adhesive-applying member (4) moves up or down, the guide roller (43) slides inside the guide groove (45) so as to guide the upward or downward movement of the rotation-restricting structure (40). The spring (44) presses down the flange portion (46) formed on the adhesive-applying member (4) for firmly contacting the main body (41) onto the flange portion (46), preventing any leakage of the adhesive caused by the compressed air pressure.

The foregoing conventional applicator, however, has several drawbacks. First, the volume of the viscous material discharged from the nozzle varies depending on the remaining amount of viscous material within the syringe, as mentioned above. Even other applicator which has overcome this problem by forcing the viscous material out of the nozzle in association with the rotation of the screw-like portion has another disadvantage in that, volume of the viscous material discharged from the nozzle may also vary because of change of viscosity of the viscous material depending, for example, on a temperature change. Another technique has been disclosed in which the syringe is totally enclosed in an insulation material so as to avoid temperature change of the adhesive. However, the insulation increases the size of the equipment. Also, the insulation fails to meet the requirement unless it has a significant thickness.

Further, for another applicators, a rotation mechanism is provided for rotating the nozzle portion around the nozzle axis in order to change the application position of the viscous material by the use of nozzle having a plurality of openings, or in order to avoid an interference, for example, between the nozzle stopper and a wiring pattern formed on a circuit substrate. Such applicator is further provided with the rotation-restricting structure so as to prevent the rotation of the viscous material-supplying tube when the viscous material-applying member is rotated by the nozzle-rotation mechanism. As a result, the whole structure of the applicator becomes so complicated, which requires an extended maintenance. Furthermore, where the rotation mechanism for rotating the nozzle around the nozzle axis is provided to the applicator in which the viscous material is forced out by the screw-like portion, the rotation of the nozzle around the axis causes a relative rotation between the viscous material-applying member and the screw-like portion therein. This may result in that the viscous material between them is also forced out disadvantageously. The relative rotation may be eliminated by rotating the screw-like portion at the same angle/velocity synchronizing with the rotation of the nozzle, which requires a complicated, rotation-synchronizing control mechanism, for example.

Therefore, a purpose of the present invention is to provide an applicator capable of avoiding a viscosity change of a viscous material, such as an adhesive, which would otherwise cause due to a temperature change of the material. Further purpose of the present invention is to provide an applicator capable of achieving a nozzle-rotating system by using a simpler structure to thereby result in a simple structure, high cost-effective and less maintenance applicator.

SUMMARY OF THE INVENTION

Therefore, according to one aspect of the presnet invention, either or both of the nozzle and the substate are moved to determine relative positions thereof, and the nozzle is moved down to discharge and then apply a predetermined volume of the viscous material onto a predetermined position of the substrate. Also, the supply tube is connected to the application member so that the supply tube is rotated together with the application member.

In another aspect of the present invention, a thermal equipment is provided in the vicinity of the nozzle for keeping a temperature in the vicinity of the nozzle substantially at a predetermined value.

In another aspect of the present invention, a thermal equipment is provided in the vicinity of the nozzle or the inlet of the application member for keeping the temperature in the vicinity of the nozzle or the inlet of the application member for receiving the viscous material substantially at a predetermined value.

In another aspect of the present invention, a locking mechanism is provided for locking the application member into a hollow cylindrical spline shaft which is a member for holding and moving up and down the application member. The mechanism has a pair of J-shaped grooves each of which extends from one end of the spline shaft along an axial direction thereof, and a pair of pins each of which is fixed vertically to the application member for being inserted in each of the J-shaped grooves. Thereby, the locking mechanism locks the application member by inserting each of the pins into one end of each of the J-shaped grooves formed in the end portion of the spline shaft, sliding it along the J-shaped groove, and making it contact with the other end of the J-shaped groove.

A method for applying a viscous material of the present invention has discharging a predetermined volume of the viscous material from a nozzle to a predetermined position of a firmly held substrate for receiving the viscous material, and applying the viscous material on the predetermined position of the substrate. In particular, the viscosity of the viscous material is kept substantially constant by keeping the temperature in the vicinity of the nozzle substantially at a predetermined value to thereby stabilize the volume of the viscous material applied.

DETAILED DESCRIPTION OF THE PREFERRED EMBODIMENTS

With reference to the drawings, an applicator using a viscous material or adhesive according to the first embodiment of the present invention will be described in detail hereinafter.

Figure 1:
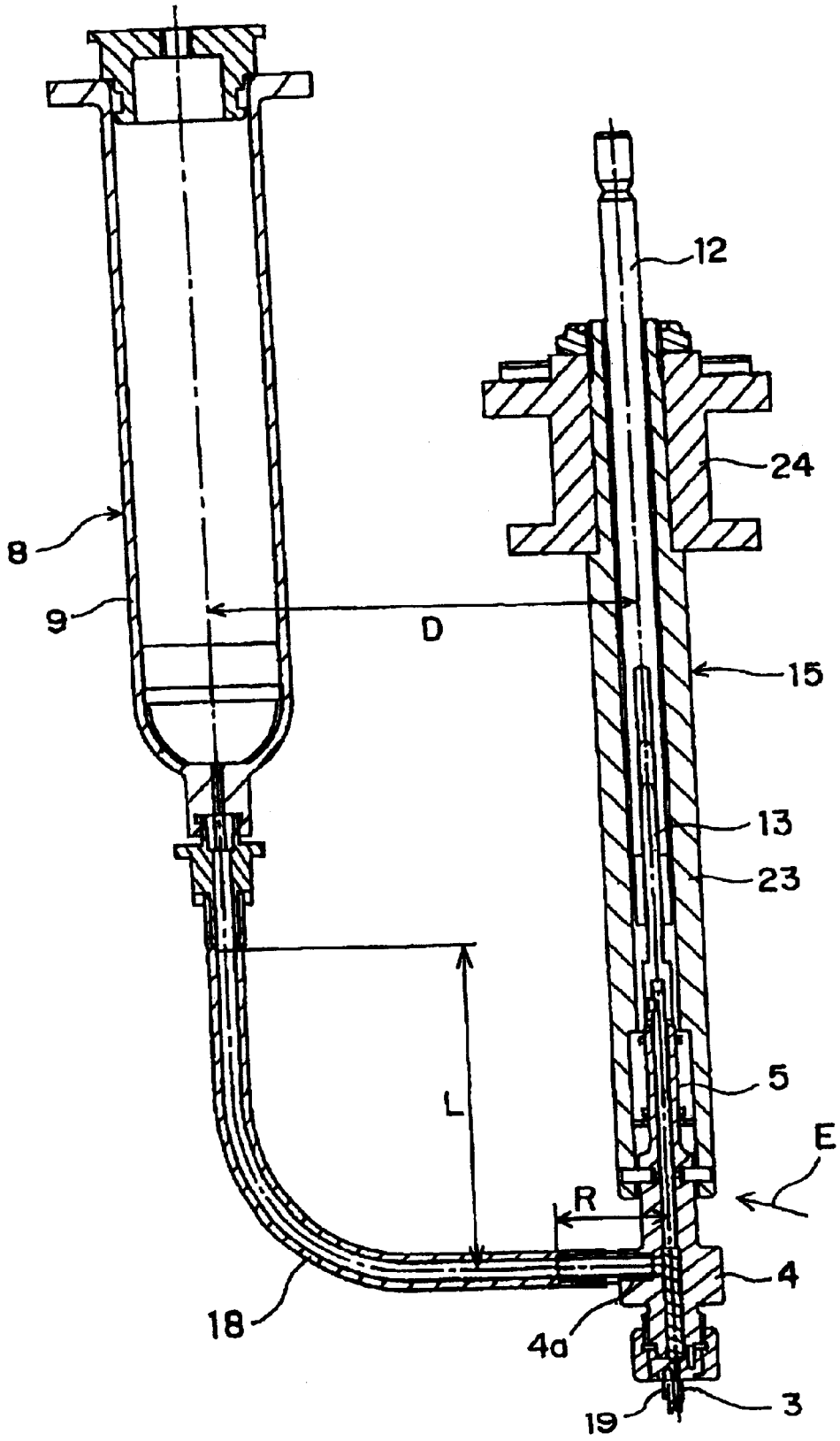
FIG. 1 is a cross sectional view of an adhesive supply unit and an adhesive discharge mechanism arranged in an applicator according to one embodiment of the present invention.

FIG. 1 shows in part an applicator according to the first embodiment, i.e., an adhesive supply unit (8) connected to an adhesive discharge mechanism (15). Generally, the applicator has certain structures and arrangements similar to those of conventional applicator described above. Therefore, the description set forth below addresses mainly to several improvements. The adhesive discharge mechanism (15) has a nozzle (3) mounted for rotation around a longitudinal axis thereof. As described with reference to FIGS. 7 and 8, the adhesive-applying member (4) is rotated by the pulley (27) secured to the outer peripheral surface of the spline shaft (23) to which the adhesive-applying member (4) is locked.

Figure 7:
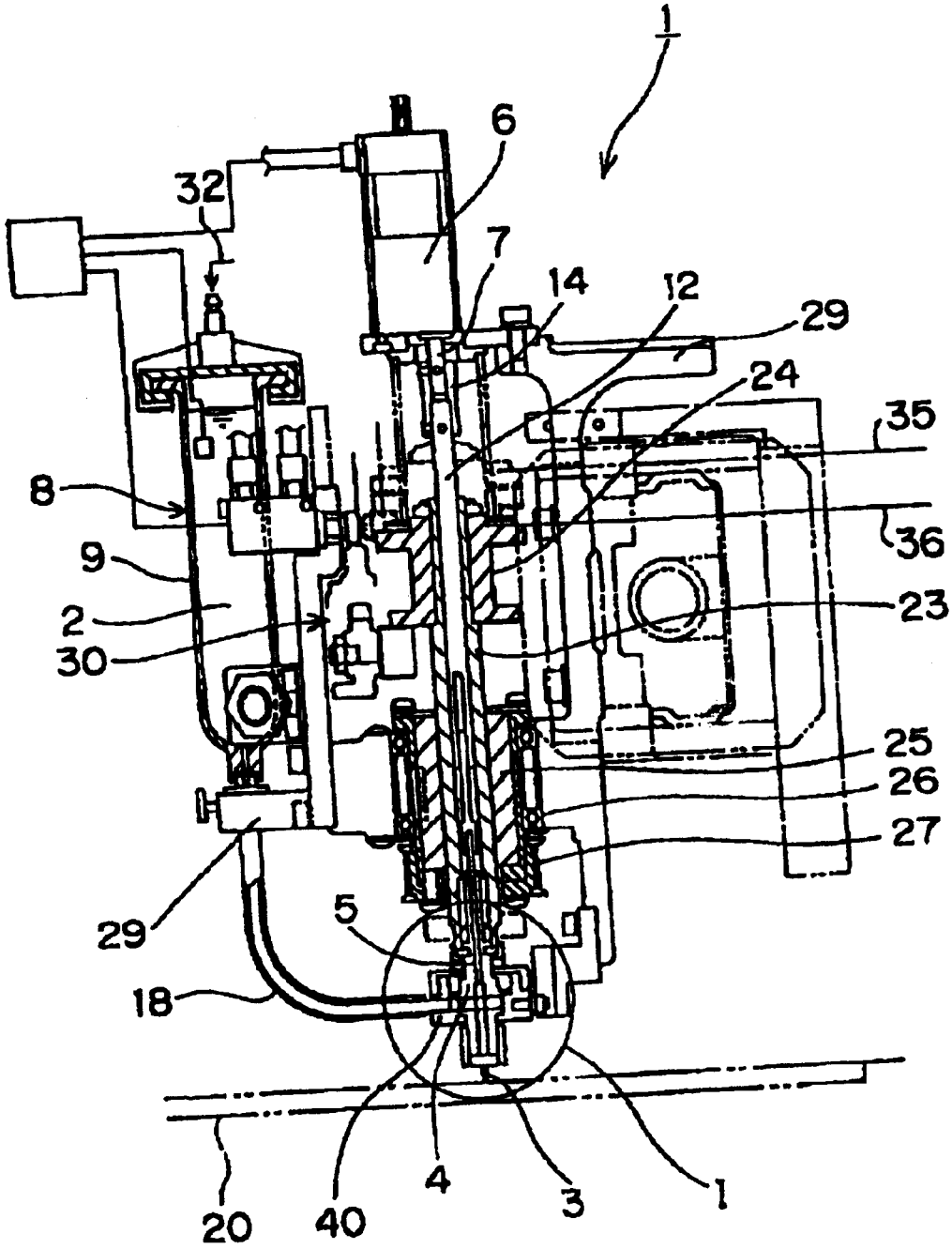
Fig. 7 Prior Art
FIG. 7 is a partial cross sectional view of the adhesive-applying head of another conventional applicator.
Figure 8:
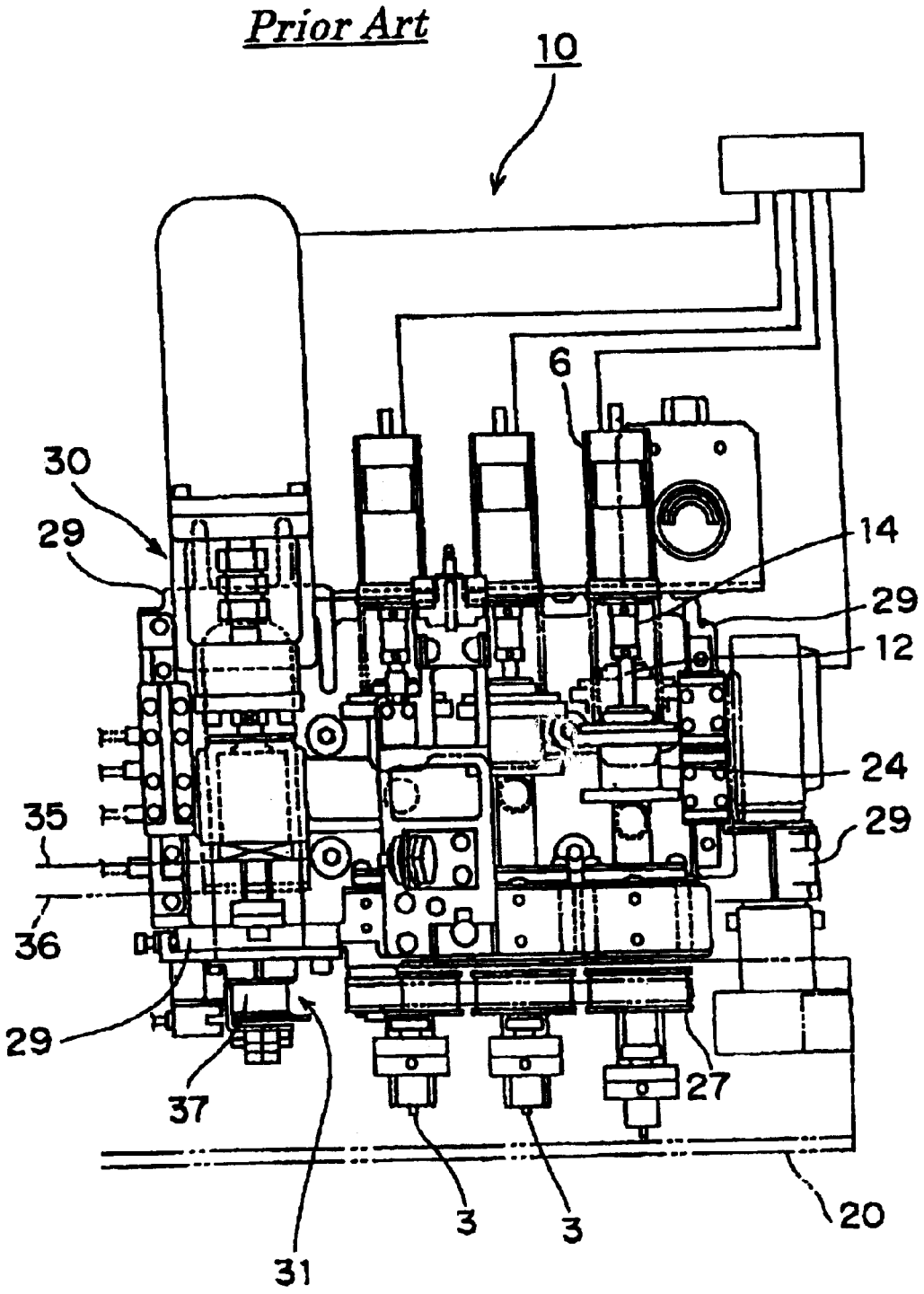
FIG. 8 is a front elevational view of the adhesive-applying head shown in FIG. 7.

In particular, although the conventional adhesive-supplying tube (18) shown in FIG. 7 is connected to the adhesive discharge mechanism (15) via the rotation-restricting structure (40) so as to prevent rotation of the adhesive-supplying tube (18), as shown in FIG. 1 the adhesive-supplying tube (18) of the present invention is directly connected to the adhesive-applying member (4) Accordingly, the adhesive-supplying tube (18) is driven to rotate in a direction perpendicular to the drawing when the nozzle (3) rotates around its longitudinal axis.

Conducted were endurance tests using the adhesive-supplying tube (18) made from vinyl chloride in which the nozzle (3) was rotated in a range of ±90°. As a result, the adhesive-supplying tube (18) sufficiently resisted 10,000 hour operation, i.e., 3,300,000 rotations. The tube of vinyl chloride had an outer diameter of 6 mm, an inner diameter of 3 mm, and a length of 135 mm. The length (135 mm) was about 35 mm longer than that of the adhesive-supplying tube used for the conventional rotation-restricted, adhesive discharge structure. In spite of this, even in another endurance test for an adhesive-applying head equipped with three nozzles in a row, no interference between the tubes and the nearby discharge mechanism was observed. The mechanism for the test was designed that arm length rotated by the adhesive-applying member (4) (the dimension R in FIG. 1) was 19 mm, the difference in height between the outlet of the syringe (9) and the inlet (4*a*) of the adhesive-applying member (4) (the dimension L in FIG. 1) was 55 mm, and the distance between the axis of the syringe (9) and the axis of the adhesive-applying member (4) (the dimension D in FIG. 1, was 73 mm.

As described above, it has proved that the adhesive-supplying tube (18) endures for at least one set of operations in which the applicator is operated continuously without any change. This ensures that, simply by changing the tube (18), the continuous operation is performed during one set of operation. Preferably, the tube (18) is discarded because the extended use of the tube requires cleanings of the tube for removing a residue of the adhesive. This in turn means that it is more economical to discard the tube (18) after the set of operations than to reuse it. Also, the adhesive-applying member (4) of the present embodiment allows the rotation-restricting structure (40) to be eliminated, which reduces the number of structural components and, as a result, manufacturing cost of the applicator. Besides, maintenance procedures required after each completion of the set of operations are reduced considerably. It should be noted that the conventional applicator with the rotation-restricting structure requires a cleaning operation in which the adhesive remaining within small recesses are removed. Comparing with this, the work load for the maintenance of the applicator according to the present invention is reduced to only about ⅕ to ⅙.

The details of the adhesive-supplying tube (18) described above is given for an illustrative purpose only, and the tube (18) may be formed from other flexible materials instead of vinyl chloride, and the dimensions of the tube may be altered provided that the tube meets a certain durability required therefor. For example, a flexible synthetic resin tube such as a urethane tube may be used instead of the above-described adhesive-supplying tube (18).

Figure 2A:
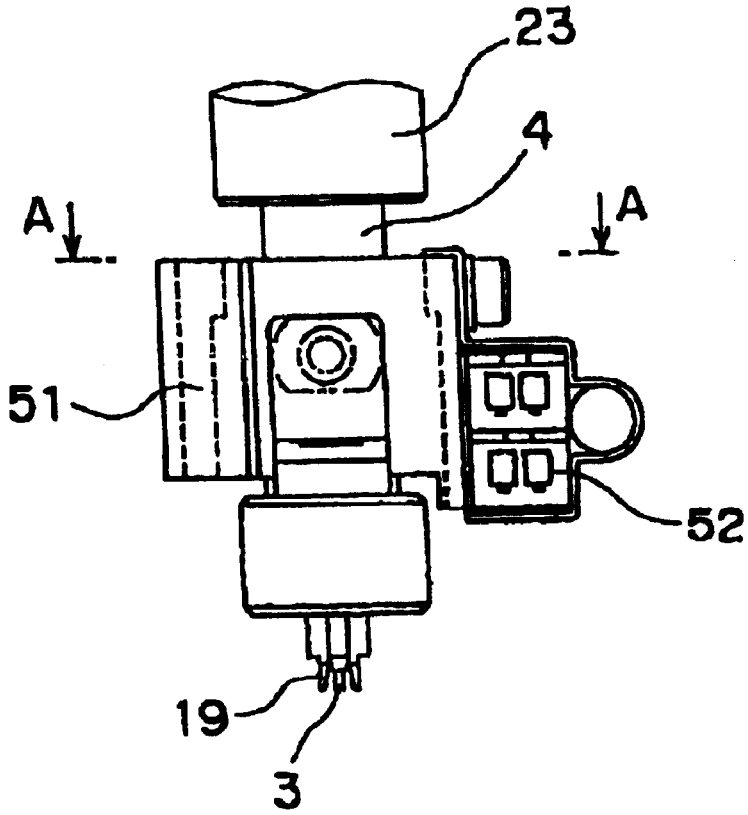
FIG. 2A is a side elevational view of the main elements of an adhesive-applying member arranged in the applicator according to another embodiment of the present invention.
Figure 2B:
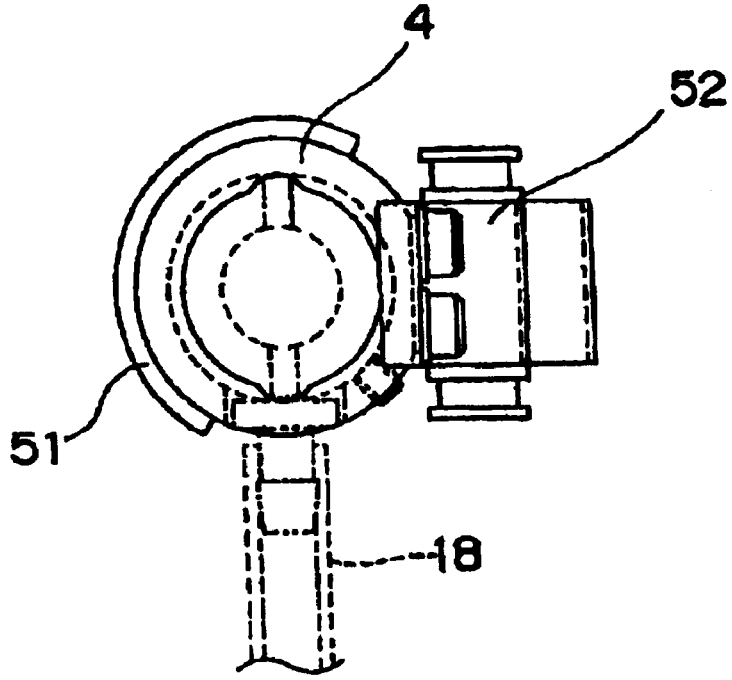
FIG. 2B shows a plan view of the main elements of an adhesive-applying member shown in FIG. 2A.
Figure 4:
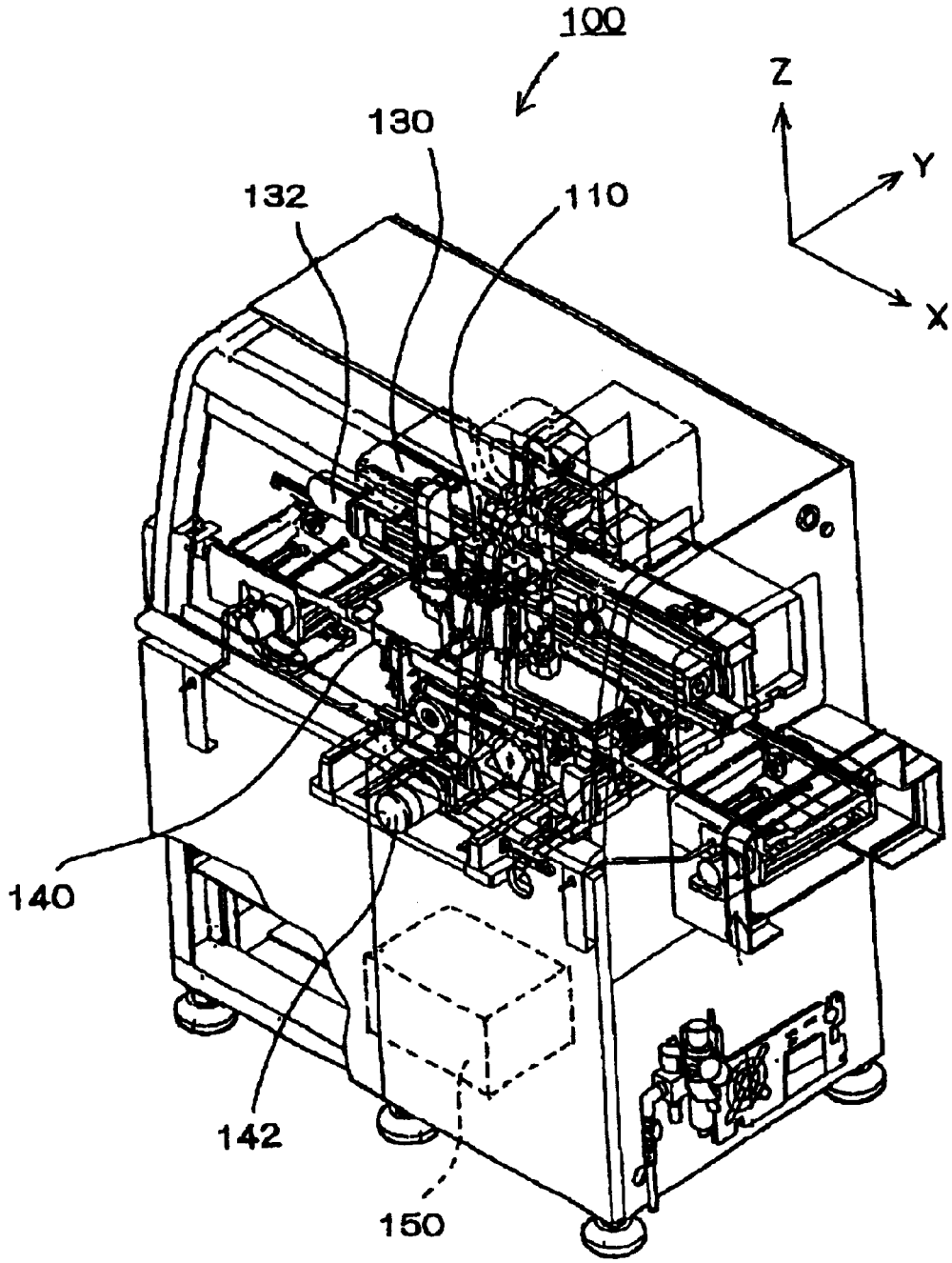
Fig. 4 Prior Art
FIG. 4 is a perspective view of a conventional applicator.
Figure 5:
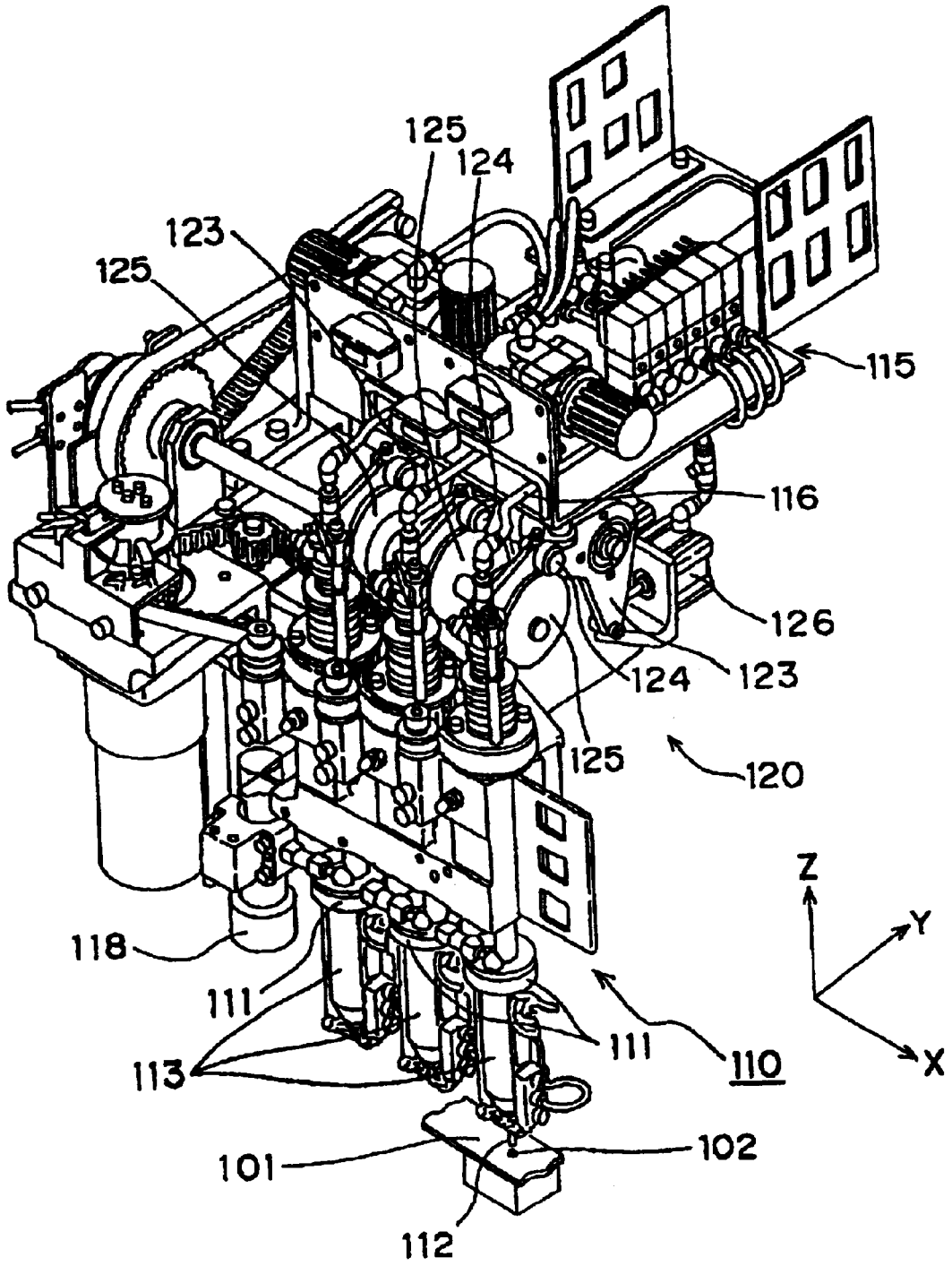
Fig. 5 Prior Art
FIG. 5 is perspective view of an adhesive-applying head arranged in the applicator shown in FIG. 4.
Figure 6:
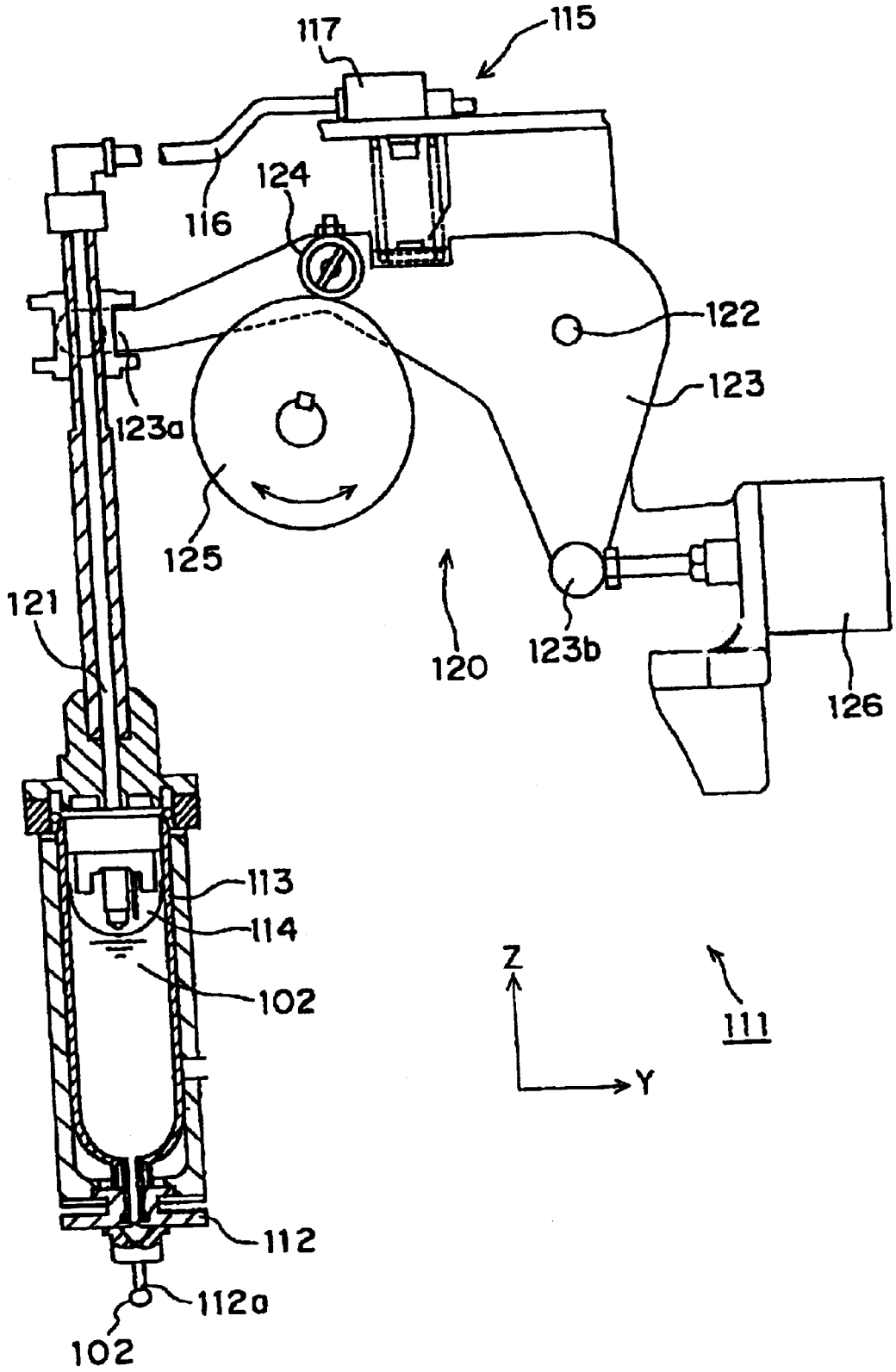
Fig. 6 Prior Art
FIG. 6 is a partial cross sectional view of the adhesive-applying mechanism of the adhesive-applying head shown in FIG. 5.

Next, a second embodiment of the present invention will be described with reference to FIGS. 2A and 2B. The drawings show the adhesive-applying member (4) of the applicator and, in particular, a part of one end of the adhesive-applying member (4) near the nozzle (3). In this embodiment, the adhesive-supplying tube (18) is directly connected to the adhesive-applying member (4) so that the adhesive (2) having passed through the adhesive-supplying tube (18) by the aid of the air pressure is directly supplied to the adhesive-applying member (4). A rubber heater (51) and a thermal resistor (52) are provided to the outer peripheral surface of the adhesive-applying member (4). The rubber heater (51) and the thermal resistor (52) are electrically connected to a control unit (not drawn) so as to control the temperature of the adhesive-applying member (4). The controller (see reference numeral 150 in FIG. 4) for controlling the overall operations of the applicator may function as a control unit.

In particular, according to this embodiment, the rubber heater (51) is attached to the outer peripheral surface, parallel to the axis of the adhesive-applying member (4), so as to cover substantially one half (about 180°) of its outer peripheral surface. The rubber heater (51) may cover more or less portions of the adhesive-applying member (4) as necessary. The rubber heater (51) has a adhesive rubber sheet in the form of tape and a heating element disposed on the surface of the rubber sheet, and the wire is heated by a current passing therethrough, so as to work as a heater. Preferably, the wire is made from nickel-chrome alloy commercially available under the trade mark of Nichrome. The thermal resistor (52) detects the temperature of the adhesive-applying member (4) and then transmits corresponding signals to the above control unit. This allows the control unit to perform a predetermined temperature control. By arranging the rubber heater (51) and the thermal resistor (52) adjacent to each other, it is possible to control the temperature within a range of about ±1° or less. The viscosity of the adhesive may also be kept substantially constant by keeping temperature of the adhesive-applying member (4) substantially constant, which realizes a reliable adhesive-application. Another temperature-detecting means may also be used instead of the thermal resistor (52).

The reference or target temperature may optionally be set at any level by the control unit, depending on viscosity of the adhesive to be used. Also, an air nozzle may be arranged in the vicinity of the adhesive-applying member (4) so as to blow air therefrom for cooling the adhesive-applying member (4). If necessary, a cooled air at even lower temperature may be used to reduce the temperature in a short time. The rubber heater (51) for use in heating may be used in combination with the air nozzle for use in cooling.

In another preferable embodiment, a thermoelectric cooling element such as Peltier element may be used instead of the rubber heater (51) to keep the temperature of the adhesive-applying member (4) constant. The thermoelectric cooling element uses the Peltier effect that heat is absorbed at the junction of two dissimilar metals carrying a small current. Using this effect, heat can be evolved by flowing electric current in the opposite direction. Therefore, another thermal equipment including the thermoelectric cooling element may be provided to the outer peripheral surface of the adhesive-applying member (4) as the rubber heater (51). This also achieves a precise temperature control, so that the volume of the adhesive to be applied can be stabilized.

As described above, the thermal equipment is simply attached to the periphery of the adhesive-applying member (4). This eliminates the conventional large heat-insulating chamber surrounding a whole of the adhesive-applying mechanism, which further simplifies the equipment. In addition, the temperature may be controlled more precisely because the thermal control may be performed in the vicinity of the nozzle (3).

Figure 9:
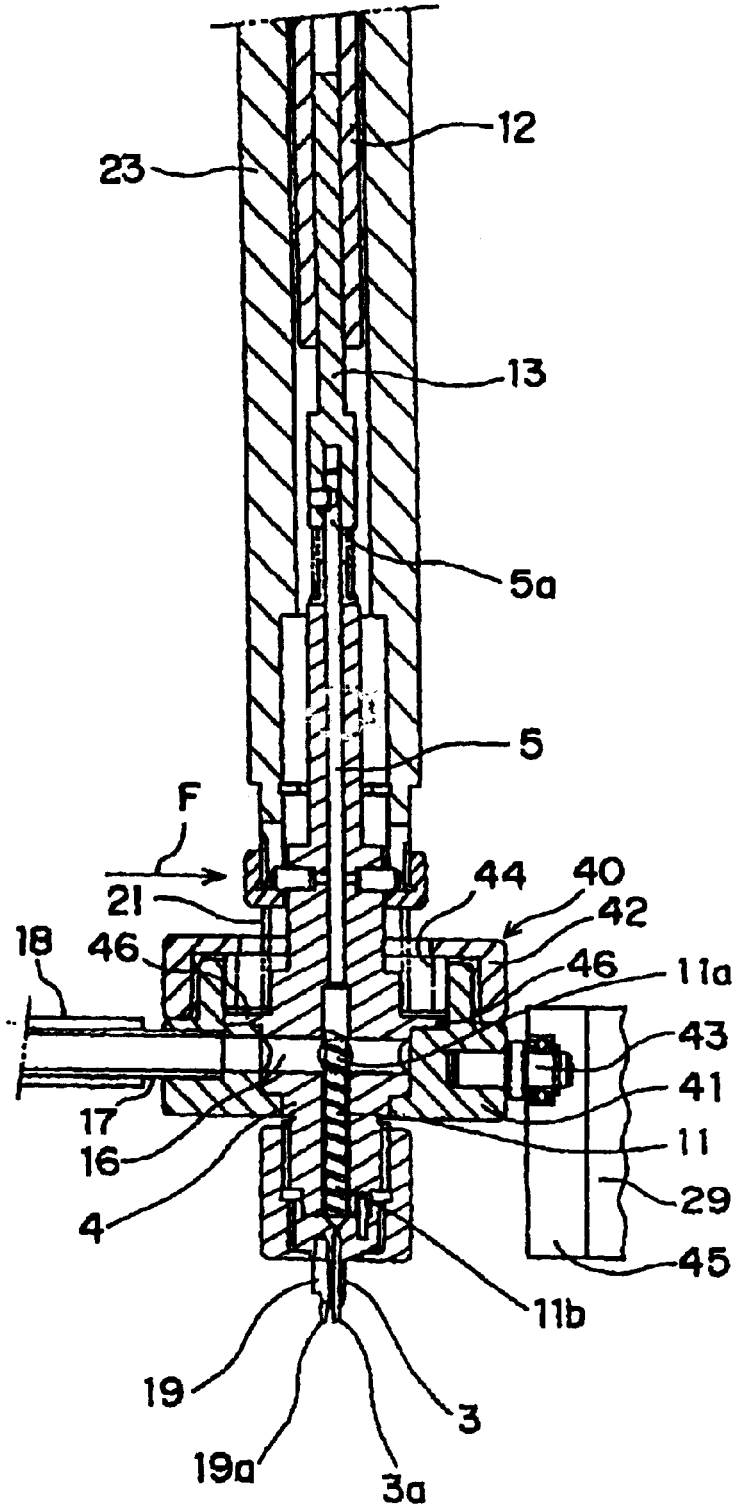
Fig. 9 Prior Art
FIG. 9 is a cross sectional view of main elements of the adhesive-applying mechanism of the adhesive-applying head shown in FIG. 7.

Next, the third embodiment of the present invention will be described hereinafter. First, FIG. 3B shows a part of the conventional applicator, which is is indicated by alphabet F in FIG. 9. In this conventional applicator, the adhesive-applying member (4) is locked to the spline shaft (23) via a pair of pins (56) vertically fixed to the adhesive-applying member (4). A pair of grooves (55) are formed in the end portion of the spline shaft (23) along its axis, and a pair of the pins (56) are inserted into theses grooves (55), respectively. Then, a cap nut (57) through which the adhesive-applying member (4) penetrates is fastened onto the threaded portion (58) formed on the outer peripheral surface of the spline shaft (23). As can be seen, the drawing shows only a portion of the adhesive-applying member (4) where the pins (56) are fixed, and other portions thereof which extend at both sides of the axial direction are omitted for clarity. The pins (56) are slidably mounted in the grooves (55) so as to define a space for absorbing a shock derived by relative movement of the adhesive-applying member (4) and the spline shaft (23) along the axial direction when the nozzle stopper (19) moves down together with the nozzle (3) and thereby contacts with a circuit substrate.

Figure 3A:
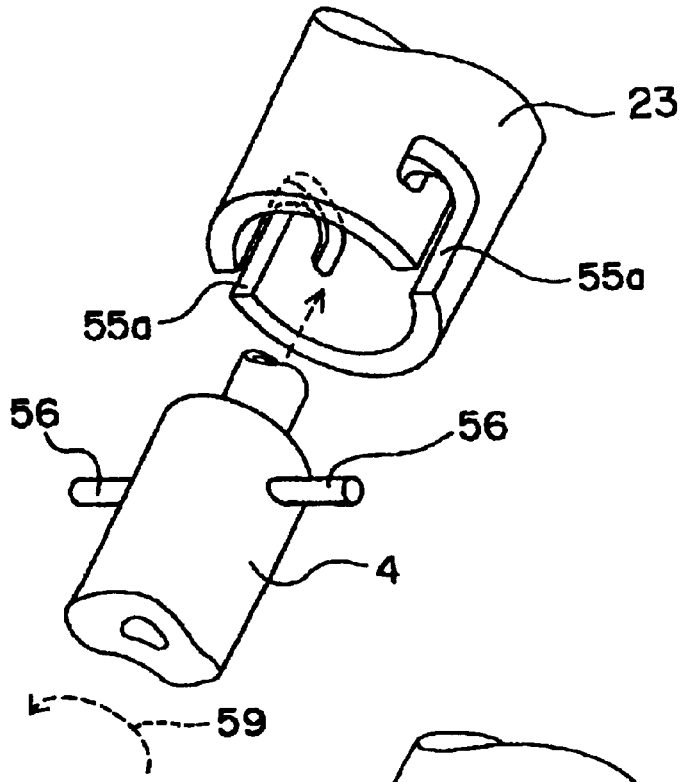
FIG. 3A is a perspective view of a locking mechanism for an adhesive-applying member arranged in the applicator according to still another embodiment of the present invention.
Figure 3B:
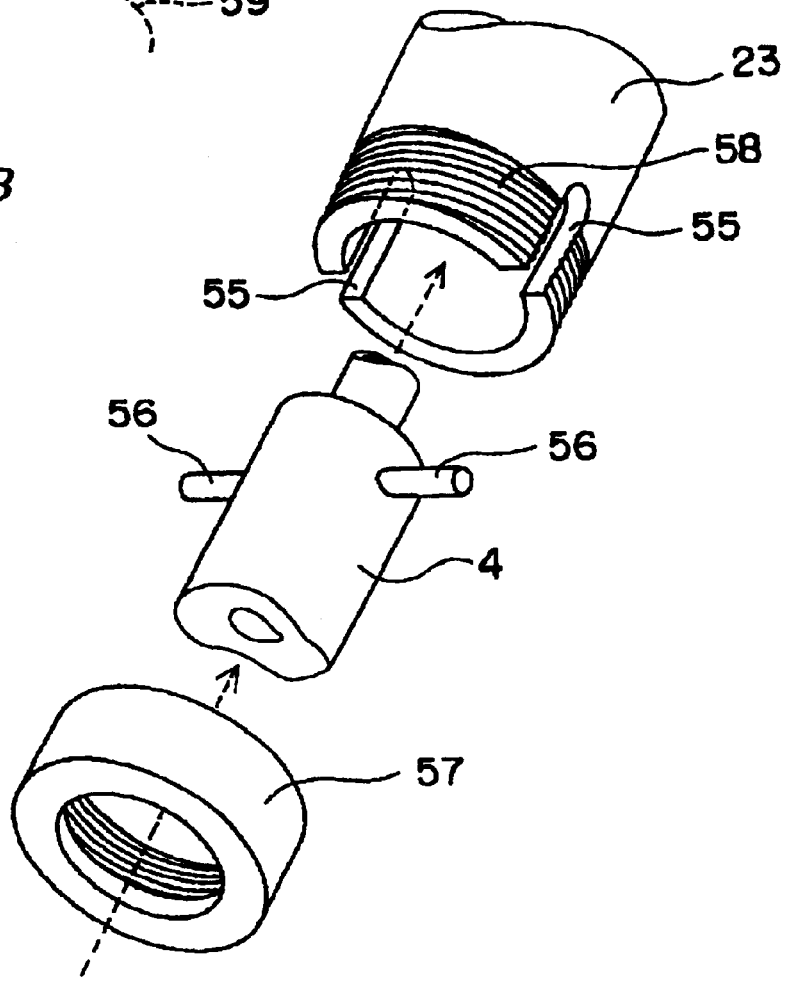
FIG. 3B is a perspective view of a locking mechanism for an adhesive-applying member arranged in the applicator according prior art.

In contrast, as shown in FIG. 3A, according to the locking structure of the adhesive-applying member (4) of the present embodiment, a pair of J-shaped grooves **(55*a*) are formed along the axial direction at the end portion of the spline shaft (23). With this arrangement, the adhesive-applying member (4) is locked in the spline shaft (23). In this process, initially a pair of the pins (56) vertically fixed to the adhesive-applying member (4) are inserted into one ends of the J-shaped grooves (55*a*) at the end portion of the spline shaft (23) along the axial direction. Then, the pins are moved forward along the grooves as shown by the arrow. Next, the adhesive-applying member (4) is twisted around its axis as indicated by arrow (59) so as to slide the pins along the J-shaped grooves. And then, the adhesive-applying member (4) is moved in the opposite direction (downward) along its axis so as to make the pins (56) contact with the other ends of the J-shaped grooves (55*a*). The upward movement of the adhesive-applying member (4) is inhibited by the action of a separately provided spring forcing the adhesive-applying member (4) downward, so that the adhesive-applying member (4) is locked in the spline shaft (23). In this condition, the pins (56) are slidable along the J-shaped grooves (55*a*) at its shorter portion of the grooves extending along the axial direction. This causes a space for absorbing an impact received when the adhesive-applying member (4) and the spline shaft (23)** move relatively to each other along the axial direction.

In addition, the cap nut included in the conventional applicator is no longer needed and, therefore, the threaded portion (58) formed on the outer peripheral surface of the spline shaft (23) is unnecessary. Thus, the number of the components decreases, the locking structure becomes simpler, and the locking or unlocking operation becomes easier. The mechanism for locking or unlocking the adhesive-applying member (4) can be applied not only to the adhesive-applying member in which the nozzle (3) is rotated around the axis, but also to the adhesive-applying member in which the nozzle is fixed, and not rotated.

In the embodiment in FIG. 3A, the J-shaped grooves **(55*a*) are extended from the interior of the spline shaft (23) to its outer peripheral surface. However, the grooves may be formed only in the inner surface of the spline shaft (23), not reaching the outer peripheral surface thereof. In this instance, the pins (56*a*) fixed to the adhesive-applying member (4)** may fit in these grooves.

As can be seen from above, according to the applicator of the present invention in which the viscous material-supplying tube is directly connected to the viscous material-applying member, the viscous material-supplying tube suffers from no damage even when it is waggled at the rotation of the nozzle. This causes the conventional rotation-restricting structure to be eliminated, which simplifies the structure of the applicator and reduces the maintenance time down to from about ⅕ to ⅙.

Also, according to the applicator of the present invention having the thermal system for keeping the temperature substantially constant in the vicinity of the nozzle, the temperature of the nozzle is kept substantially constant in a precise manner by simply attaching the rubber heater, for example. With this arrangement, the viscosity of the viscous material is kept constant to thereby stabilize the volume of the viscous material to be applied.

Further, according to the applicator having the locking structure for locking the viscous material-applying member to the spline shaft, locking or unlocking operation of the viscous material-applying member is simplified. This reduces the number of components, which is so economical. Also, this eases the setup and maintenance procedures of the applicator.

Although the present invention has been fully described with reference to viscous material applicator, it is applicable to any other systems for applying a certain volume of viscous material. Examples of such viscous material include cream solder, silver paste or other welding materials, sealant, fillers such as under-fillers.

What is claimed is:

1. An apparatus for applying a viscous material, comprising:

a syringe for holding a viscous material;

a pressure apply device for applying pressure in an interior of the syringe;

an application member for receiving and guiding the viscous material forcedly supplied by the pressure;

a supply tube, connecting the syringe and the application member, for supplying the viscous material from the syringe to the application member;

a discharge shaft inserted in an interior of the application member extending in an axial direction thereof and provided at one end thereof with a screw-like portion rotatable around a longitudinal axis thereof to forcedly move the viscous material guided by the application member in the axial direction;

a nozzle for discharging the viscous material forcedly moved by the rotation of the discharge shaft;

a rotation mechanism for rotating the nozzle around the axis;

a holding device for firmly holding a substrate onto which the viscous material is applied, and a controller, wherein, under control by the controller, either or both of the nozzle and the holding device are moved to determine relative positions thereof, and the nozzle is moved down to discharge and then apply a predetermined volume of the viscous material onto a predetermined position of the substrate, wherein the supply tube is connected to the application member so that the supply tube is rotated together with the application member.

2. The apparatus according to claim 1, wherein the supply tube is made from a flexible tube of a synthetic resin.

3. An apparatus for applying a viscous material, comprising:

a syringe for holding a viscous material;

a pressure apply device for applying pressure in an interior of the syringe;

a nozzle for discharging the viscous material forcedly supplied by the pressure;

a holding device for introducing and firmly holding a substrate onto which the viscous material is applied, and a controller, wherein, under control by the controller, either or both of the nozzle and the holding device are moved to determine relative positions thereof, and the nozzle is moved down to discharge and then apply a predetermined volume of the viscous material onto a predetermined position of the substrate, wherein a thermal equipment is provided in the vicinity of the nozzle for keeping a temperature in the vicinity of the nozzle substantially at a predetermined value.

4. The apparatus according to claim 3, wherein a rotation mechanism is provided for rotating the nozzle around the axis.

5. The apparatus according to claim 3, wherein the thermal equipment comprises either or both of a heating element and a cooling element, a temperature-detecting means, and a control unit.

6. The apparatus according to claim 5, wherein the heating element comprises a rubber heater.

7. The apparatus according to claim 5, wherein the cooling element comprises an air nozzle for blowing cooled air.

8. The apparatus according to claim 5, wherein the heating element and the cooling element comprise a thermoelectric cooling element.

9. The apparatus according to claim 5, wherein the is controller functions as the control unit.

10. An apparatus for applying a viscous material, comprising:

a syringe for holding a viscous material;

a pressure apply device for applying pressure in an interior of the syringe;

a application member for receiving and guiding the viscous material forcedly supplied by the pressure;

a supply tube, connecting the syringe and the application member, for supplying the viscous material from the syringe to the application member;

a discharge shaft inserted in an interior of the application member extending in an axial direction thereof and provided at one end thereof with a screw-like portion rotatable around a longitudinal axis thereof to forcedly move the viscous material guided by the application member in the axial direction;

a nozzle for discharging the viscous material forcedly moved by the rotation of the discharge shaft;

a holding device for firmly holding a substrate onto which the viscous material is applied, and a controller, wherein, under control by the controller, either or both of the nozzle and the holding device are moved to determine relative positions thereof, and the nozzle is moved down to discharge and then apply a predetermined volume of the viscous material onto a predetermined position of the substrate, wherein a thermal equipment is provided in the vicinity of the nozzle or the inlet of the application member for keeping the temperature in the vicinity of the nozzle or the inlet of the application member for receiving the viscous material substantially at a predetermined value.

11. A viscous material-applying apparatus comprising:

a syringe for holding a viscous material;

a pressure apply device for applying pressure in an interior of the syringe;

a application member for receiving and guiding the viscous material forcedly supplied by the pressure;

a supply tube, connecting the syringe and the application member, for supplying the viscous material from the syringe to the application member;

a discharge shaft inserted in an interior of the application member extending in an axial direction thereof and provided at one end thereof with a screw-like portion rotatable around a longitudinal axis thereof to forcedly move the viscous material guided by the application member in the axial direction;

a nozzle for discharging the viscous material forcedly moved by the rotation of the discharge shaft;

a holding device for firmly holding a substrate onto which the viscous material is applied, and a controller, wherein, under control by the controller, either or both of the nozzle and the holding device are moved to determine relative positions thereof, and the nozzle is moved down to discharge and then apply a predetermined volume of the viscous material onto a predetermined position of the substrate, wherein a locking mechanism for locking the application member into a hollow cylindrical spline shaft which is a member for holding and moving up and down the application member comprises a pair of J-shaped grooves each of which extends from one end of the spline shaft along an axial direction thereof, and a pair of pins each of which is fixed vertically to the application member for being inserted in each of the J-shaped grooves, and the locking mechanism locks the application member by inserting each of the pins into one end of each of the J-shaped grooves formed in the end portion of the spline shaft, sliding it along the J-shaped groove, and making it contact with the other end of the J-shaped groove.

12. The apparatus according to claim 11, further comprising a rotating mechanism for rotating the nozzle around the axis.

* * * * *

UNITED STATES PATENT AND TRADEMARK OFFICE

CERTIFICATE OF CORRECTION

PATENT NO. : 6,761,769 B2
DATED : July 13, 2004
INVENTOR(S) : Yuzuru Inaba et al.

It is certified that error appears in the above-identified patent and that said Letters Patent is hereby corrected as shown below:

Column 11,
Line 23, delete “is” after “the”.

Signed and Sealed this

Seventeenth Day of May, 2005

JON W. DUDAS
*Director of the United States Patent and Trademark Office*